US006379111B1

(12) United States Patent
Katoh et al.

(10) Patent No.: US 6,379,111 B1
(45) Date of Patent: Apr. 30, 2002

(54) HIGH VOLUME VENTILATION FAN WITH NOISE ATTENUATION FOR PERSONAL COMPUTER

(75) Inventors: Katsutoshi Katoh, Tokyo-to; Yasuharu Yamada, Shiga-ken; Masaki Kobayashi, Tokyo-to; Takayuki Morino, Yamato, all of (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/611,095

(22) Filed: Jul. 6, 2000

(30) Foreign Application Priority Data

Jul. 22, 1999 (JP) ..... 11-207726

(51) Int. Cl.[7] ..... F04D 29/66
(52) U.S. Cl. ..... 415/119; 416/203; 416/229 R
(58) Field of Search ..... 415/119; 416/175, 416/203, 62, 229 R

(56) References Cited

U.S. PATENT DOCUMENTS 746,007 A * 12/1903 Bruncker ..... 416/203
1,831,729 A * 11/1931 Adamcikas et al. ..... 170/159
5,681,145 A * 10/1997 Neely et al. ..... 416/203
6,181,553 B1 * 1/2001 Cipolla et al. ..... 361/687

* cited by examiner

*Primary Examiner*—Edward K. Look
*Assistant Examiner*—Kimya McCoy
(74) *Attorney, Agent, or Firm*—J. Bruce Schelkopf; Bracewell & Patterson, LLP

(57) ABSTRACT

A ventilation fan for a PC has a plurality of blades disposed around a rotary hub. Each blade is shaped differently from the others to an extent that the air volume handling capacity of the blades is not substantially diminished. The noise level generated by a fan in a specific frequency range is caused by the change in air pressure and is attributable to the symmetry of the fan blade shapes. By altering the shape of the individual blades, the noise level due to pressure change is attenuated. Each blade slightly differs in shape from the others to eliminate air pressure changes. The noise level of the fan is suppressed within an allowable range even when the number of blades and the rotational speed of the fan are increased for better air flow. Preferably, the shape of each blade is varied from the others by putting an adhesive such as putty on the front surface and/or the back surface thereof near the hub. In addition, by putting an adhesive or putty on the front surface and/or the back surface of the blade entirely, the shape of the blade is varied from the others.

12 Claims, 7 Drawing Sheets

HIGH VOLUME VENTILATION FAN WITH NOISE ATTENUATION FOR PERSONAL COMPUTER

TECHNICAL FIELD

The present invention relates to a fan comprising a hub that rotates and a plurality of blades attached to the hub in a radial pattern around said hub, as well as a personal computer equipped with the fan.

DESCRIPTION OF THE RELATED ART

Personal computers (PC) and, in particular, notebook PCs, have seen dramatic increases in CPU speed and performance while becoming smaller in size and lighter in weight that their predecessors. As a result, the heat diffusion in modern machines also has become increasingly important. A ventilation fan is critical element in heat diffusion that is found in almost every PC and is a core element of the cooling system in PCs.

FIG. 7 shows how a fan is installed in a conventional notebook PC. FIG. 8 shows the positional relationship between the fan and the cover of the PC. In FIGS. 7 and 8, the fan 51 is of a flat type comprising a rotatable hub 53 and a plurality of blades 54 attached to hub 53 which is fixed to the rotary shaft of a motor (not shown) in the fan body 52. The blades 54 are disposed around the hub 53 in a radial pattern. The fan 51 is disposed between a cover 61 and a keyboard 62, closer to an inner surface of cover 61. In addition to the fan 51, a board 63 is also disposed between cover 61 and keyboard 62. Various elements such as a CPU 64, etc., are mounted on board 63. In FIGS. 7 and 8, blades 54 of fan 51 are rotated to pull the air between cover 61 and keyboard 62 inside the PC into fan 51 from its lower side. The air is then discharged out of the PC through vent holes 65 provided in the cover 61 at the side of the fan 51 to reduce the operating temperature of the PC.

In order to release the heat from the interior of the notebook PC with fan 51, it preferable to increase the air flow rate of fan 51. An effective way to increase the airflow rate of fan 51 is remove resistance of the air flow inside the PC, or increase the rotational speed or the number of blades of the fan. For very thin, lightweight notebook PCs, the clearance between board 63 and cover 61 must be minimized. Unfortunately, such a configuration significantly increases the resistance of the air flow and makes it virtually impossible to reduce the path of the air even slightly so as to increase the air flow rate in conventional notebook PCs.

However, when the air flow rate is increased by increasing the rotational speed and number of blades of the fan, an unpleasant and, thus, unacceptable increase in noise level is created. Thus, the rotational speed, number of blades, and the noise level of the fan are related proportionally to each other. Typically, noise generated by fan blades has a peak frequency in a range calculated by the following equation:

$$\text{Peak frequency (Hz)} = \text{number of blades} \times \text{rotational speed (rpm)}/60$$

For example, a fan having seven blades rotating at 5200 rpm in a conventional notebook PC has a peak frequency of about 600 Hz. If the number of blades is increased to nine, the peak frequency will be about 780 Hz at the same rotational speed. This equation also holds true when the rotational speed is increased above 5200 rpm while the fan has the same number of blades. However, if the peak frequency is too high, the microphone of the PC picks up the noise and disables the function. With respect to these problems experienced with conventional fans, it is an object of the present invention to provide a fan that can increase the air flow rate while keeping the noise level within a permissible range, as well as equipping a PC with such a fan.

SUMMARY OF THE INVENTION

The present invention is directed to a fan having a plurality of blades disposed around a hub that rotates, and preferably to a fan employable for a PC (Personal Computer). Each of the blades of the fan is shaped differently from the others to an extent that the air volume handling capacity of the blades is not substantially diminished. The present invention is also directed to a PC that employs such a fan as a cooling or ventilation fan.

The noise level generated by a fan in a specific frequency range is caused by the change in air pressure and is attributable to the symmetry fan blade shape. By altering the shape of the individual blades, the noise level due to the pressure changes is attenuated. Each blade of the fan slightly differs in shape from the others to eliminate the periodic occurrence of air pressure changes. The noise level of the fan is suppressed within an allowable range even when the number of blades and the rotational speed of the fan are increased so as to increase the air flow rate.

In a preferred embodiment of the present invention, the shape of each blade is varied from the others by putting an adhesive, preferably putty, on the front surface and/or the back surface thereof near the hub. In addition, by putting an adhesive or putty on the front surface and/or the back surface of the blade entirely, the shape of the blade is varied from the others. In addition, the adhesive is put on every other blade. When the fan has an odd number of blades, the adhesive blades and non-adhesive blades are disposed adjacent to one another. The fan may also be provided with nine blades and rotate at a speed in excess or 5200 rpm. The present invention can thus be achieved in a preferred manner in any of the above cases.

BRIEF DESCRIPTION OF THE DRAWINGS

FIG. 1(*b*) is a sectional view of the fan of FIG. 1(*a*) taken along the line A—A;

FIG. 2(*b*) is a sectional view of the fan of FIG. 2(*a*) taken along the line A—A;

FIG. 3(*b*) shows an embodiment of a fan having putty located on four alternate ones of the blades;

FIG. 3(*c*) shows an embodiment of a fan having putty on all the blades;

DETAILED DESCRIPTION OF THE PREFERRED EMBODIMENT

Figure 1A:
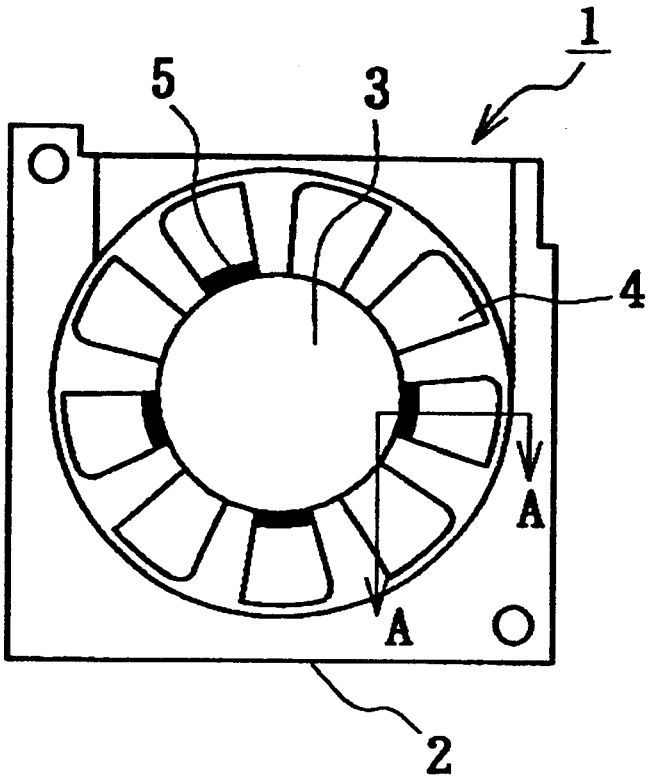
FIG. 1(*a*) is a top view of a first embodiment of a ventilation fan constructed in accordance with the present invention.
Figure 1B:
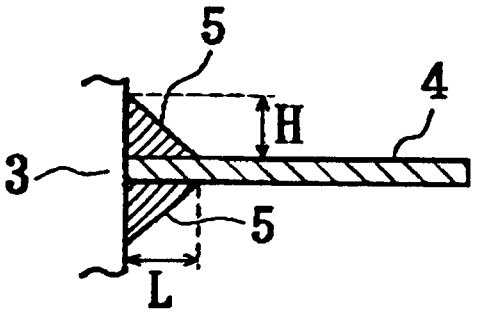

FIGS. 1(*a*) and (*b*) show a preferred embodiment of the fan of the present invention. FIG. 1(*a*) is a top view of the fan. FIG. 1(*b*) is a cross sectional view of the fan at the A—A line shown in FIG. 1(*a*). In FIGS. 1(*a*) and (*b*), a fan 1 is composed so as to have a plurality of blades 4 (nine blades in this embodiment) attached to a hub 3 so as to be disposed around the hub at equal pitches in a radial pattern. The hub 3 is fixed to a rotary shaft of a motor (not illustrated) in the fan body 2. A conventional well known method is used to form the external shape of each blade 4 and attach the blades 4 to the hub 3. Then, an adhesive 5 is put on both front and back surfaces of each of the four blades 4 of nine blades 4 to a portion 4*a* attached to the hub 3, thereby each of those four blades 4 is shaped differently from another to an extent that the capacity of the blade 4 is not substantially spoiled between an adhesive-put blade 4 and a non-adhesive-put blade 4. The adhesive 5 may be any that can fix the blades 4, but preferably it should be putty. In the description hereafter, it is premised that putty is used as such an adhesive.

The shape and size of the putty 5 are not limited specially; they depend on the size of the fan 1. As an example, the cross sectional shape should be a triangle, the maximum height H be about 1.5 mm, and the maximum length L be about 1.5 mm. In addition, as the material of the putty 5, type 3084 manufactured by ThreeBond Co., Ltd.® may be used in a preferred manner. At this time, the weight of the putty 5 on one blade is about 12 mg. In FIGS. 1(*a*) and (*b*), the putty 5 is put alternately on nine blades 4 of the fan and they are disposed so that non-putty-put blades 4 are adjacent at a place. Although the present invention is achieved by a method that the putty 5 is put on either the front surface or the back surface of each blade 4 to a portion 4*a* attached to the hub 3, the putty 5 should preferably be put on both front and back surfaces from the point of view of balance among the blades.

Figure 2A:
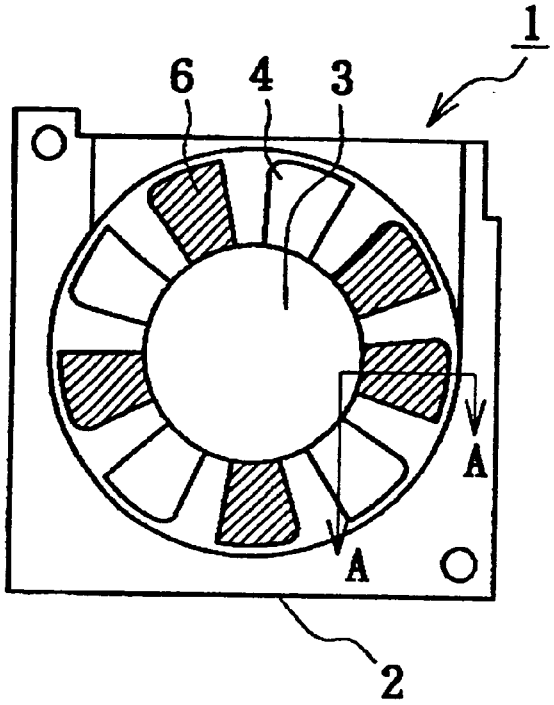
FIG. 2(*a*) is a top view of a second embodiment of a ventilation fan constructed in accordance with the present invention.
Figure 2B:
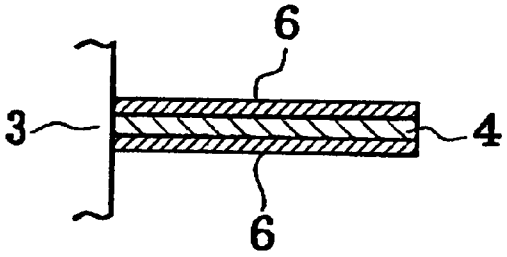

FIGS. 2(*a*) and (*b*) are another embodiment of the fan of the present invention. FIG. 2(*a*) is a top view of the fan and FIG. 2(*b*) is a cross sectional view of the fan at the A—A line shown in FIG. 2(*a*). Just like the embodiment shown in FIG. 1, the fan 1 is also composed so that nine blades 4 are disposed at equal pitches in a radial pattern around the hub 3 fixed to the rotary shaft of the motor (not illustrated) in the fan body 2 as shown in FIGS. 2(*a*) and (*b*). Putty 6 is then put on both front and back surfaces of each of the five blades 4 of the nine blades 4 entirely, thereby the shape of each of the blades 4 is varied from another to an extent that the capacity of the blade 4 is not substantially spoiled between a putty-put blade 4 and a non-putty-put blade 4. The putty 6 put entirely on both front and back surfaces of each blade 4 is uniform in thickness. In FIGS. 2(*a*) and (*b*), the putty 6 is put alternately on those blades 4, which are disposed so that putty-put blades 4 are adjacent at a place. And, although the present invention can also be achieved just like in the embodiment shown in FIG. 1 by putting the putty 6 on either the front surface or the back surface of each blade 4, the putty 6 should preferably be put on both front and back surfaces from the point of view of balance among the blades as described above.

As described above, because each of a plurality of blades 4 is shaped differently from another to an extent that the capacity of the blade 4 is not substantially spoiled, the noise of the rotating fan is reduced and softened more than the conventional fan provided with a plurality of blades 4 formed completely in the same shape if it is premised that the number of the blades 4 and the rotational speed are the same between both of the fans. "Extent that the capacity of the blade is not substantially spoiled" mentioned above means that the basic capacity of the blade for blowing air is not spoiled.

Although the fan has seven blades and a rotational speed of 5200 rpm in the embodiments of both the present invention and the related art, hereunder another fan will be picked up as an example in which the rotational speed is fixed and the number of blades is seven or over, for example, nine blades. The present invention can suppress the noise level within the allowable value, although the noise level is over the allowable value in the related art. In this case, it is premised that each blade is shaped differently from another in the present invention. In addition, the number of blades can be increased more than in the related art. And, if it is premised that the number of blades is fixed and the rotational speed is set to 5200 rpm or over in both of the present invention and the related art, the noise level that exceeds the allowable value at 5200 rpm in the related art can be suppressed within the allowable value in the present invention even when the rotational speed is not less than 5200 rpm. In addition, the rotational speed of the fan can be increased more than in the related art. As described above, according to the present invention, therefore, it is possible to increase the number of blades or the rotational speed more than that in the related art, the present invention can provide a fan that can increase the air flow rate employable appropriately to notebook PCs.

Hereunder, an embodiment of the fan of the present invention will be described more in detail. At first, three fans were prepared; the first fan had nine blades formed completely in the same shape (FIG. 3(*a*)), the second fan had nine blades and putty was put on four of those blades on both front and back surfaces to a portion attached to the hub respectively and disposed alternately (FIG. 3(*b*)), and the third fan had nine blades and putty was put on both front and back surfaces of each of those blades to a portion attached to the hub respectively (FIG. 3(*c*)). The noise level was measured at 5200 rpm for each of the three fans. The noise measuring method was as shown in FIG. 4; a fan was set between two aluminum plates that were separated from each other at a distance of 11.7 mm. A sound collector of a noise meter was covered with a sponge and spaced apart from the fan by 10 cm in the direction of the air flow from the fan. The signal detected by the noise meter was analyzed by a frequency analyzer for detecting sound pressure (dBV) for the frequency. The noise meter was Type 2234 of B&K Corporation® and the frequency analyzer was FFT analyzer CF-360 manufactured by Ono Sokki Co., Ltd.®

Figure 3A:
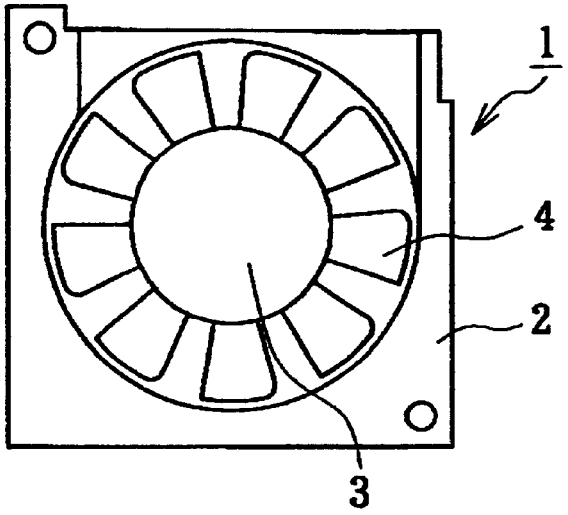
FIG. 3(*a*) shows an embodiment of a fan having blades formed completely in the same shape.
Figure 3B:
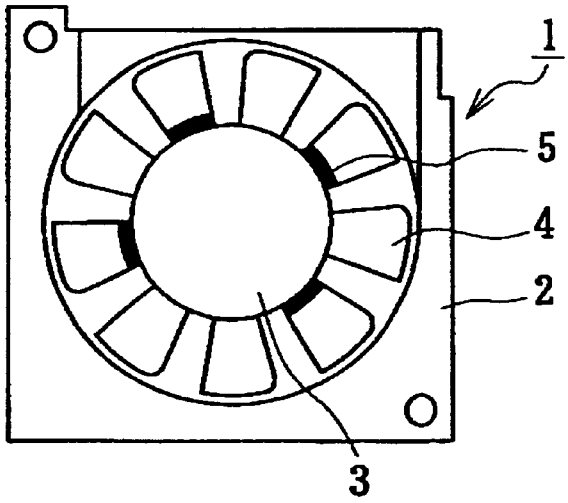
Figure 3C:
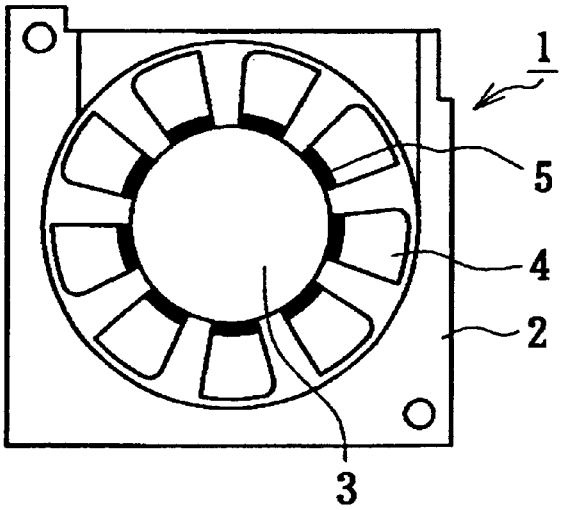
Figure 4:
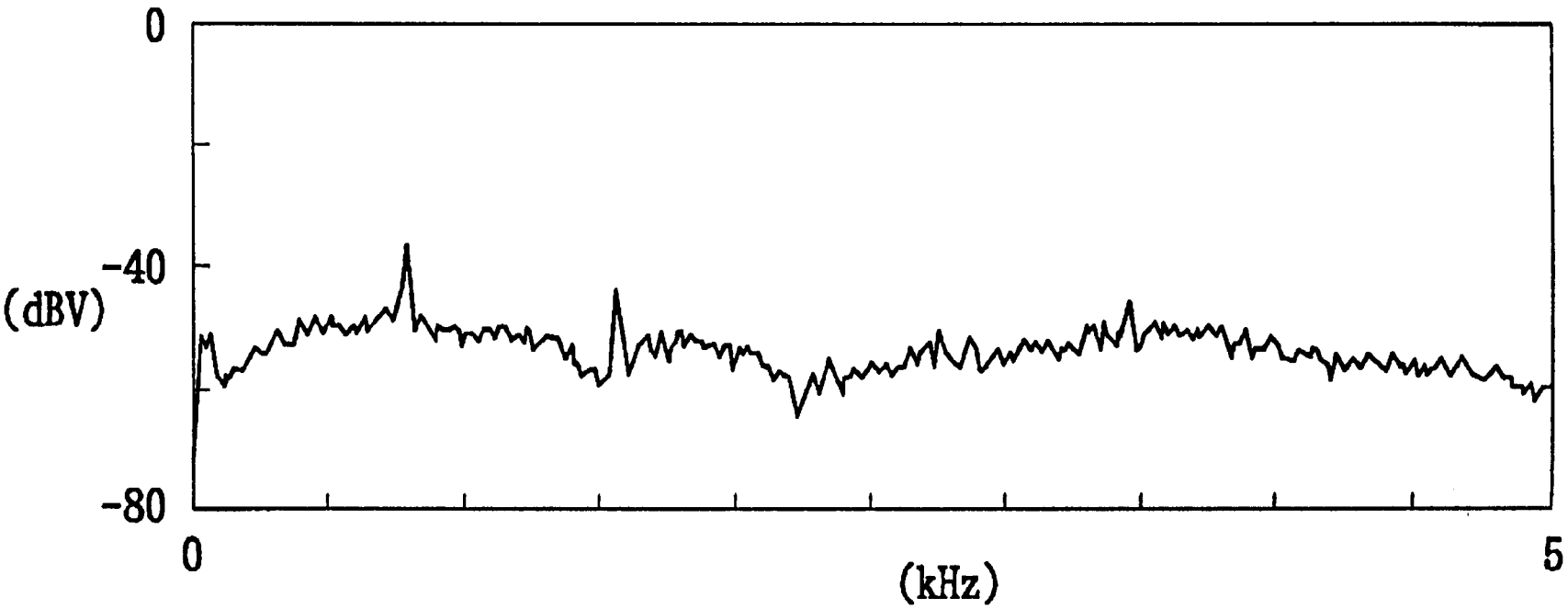
FIG. 4 is a plot of the noise level of the fan of FIG. 3(*a*)
Figure 5:
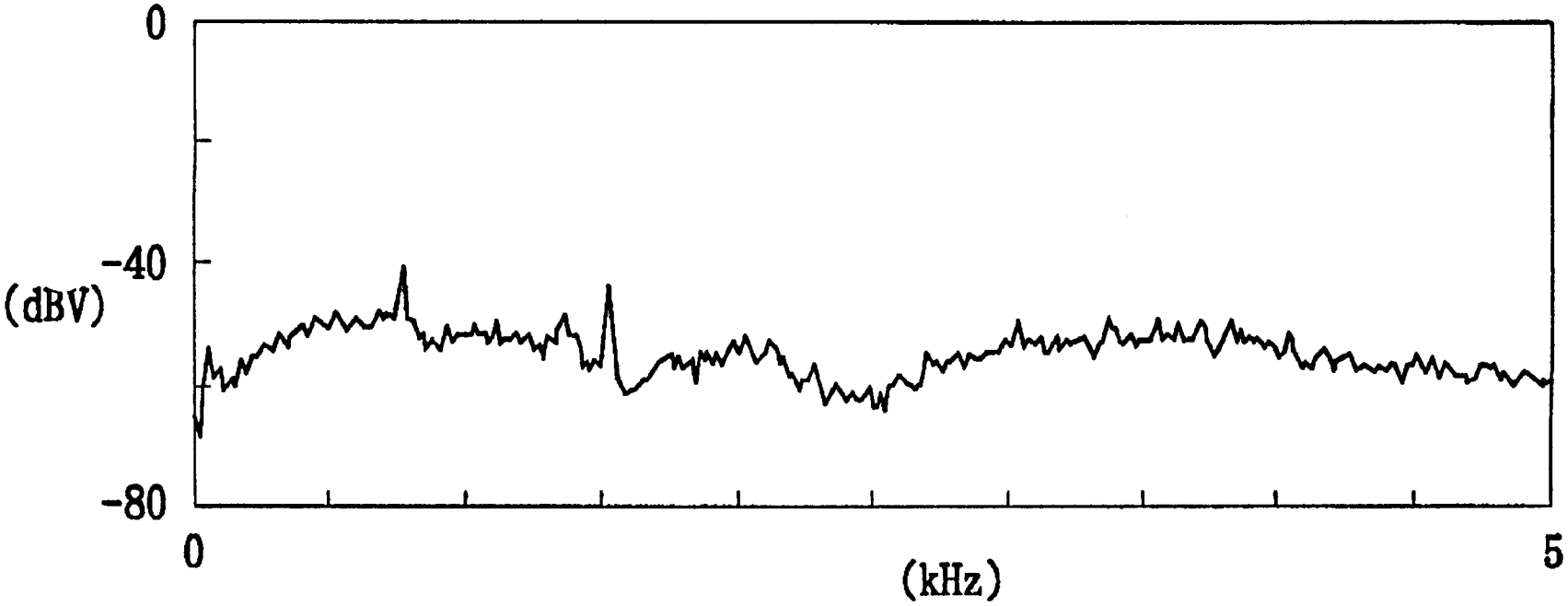
FIG. 5 is a plot of the noise level of the fan of FIG. 3(*b*)
Figure 6:
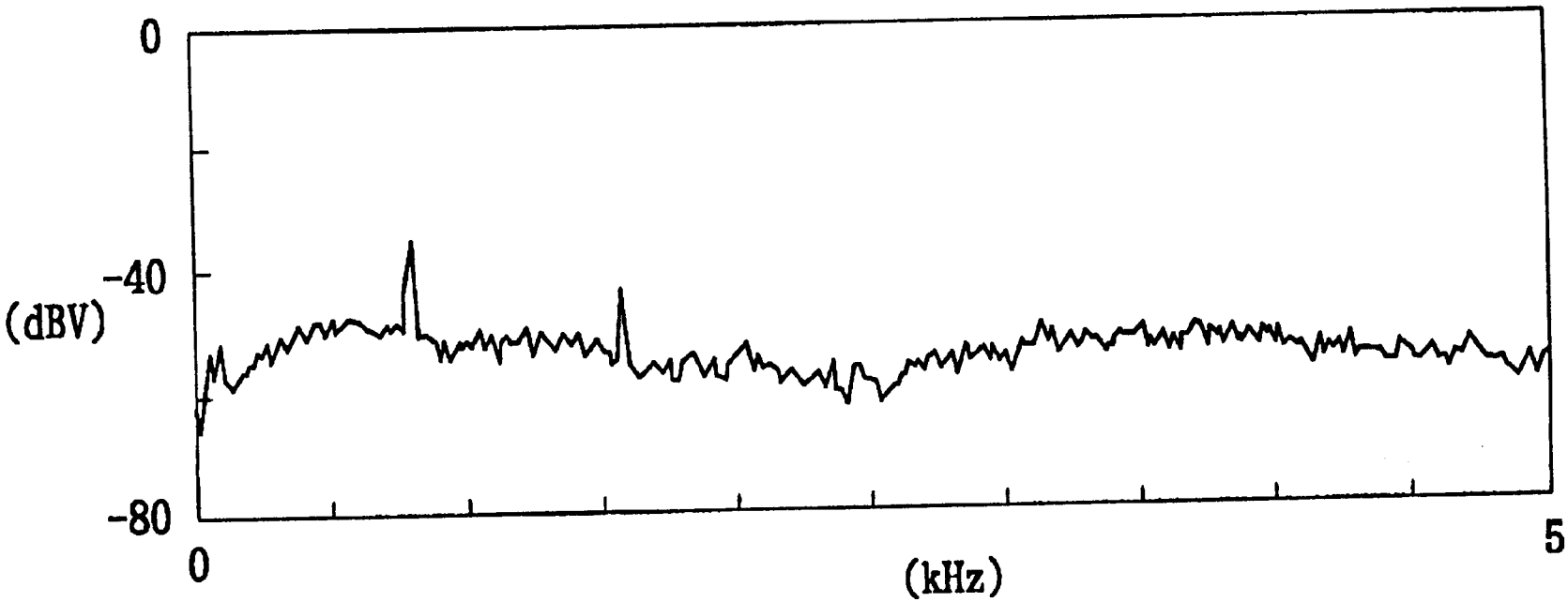
FIG. 6 is a plot of the noise level of the fan of FIG. 3(*c*)
Figure 7:
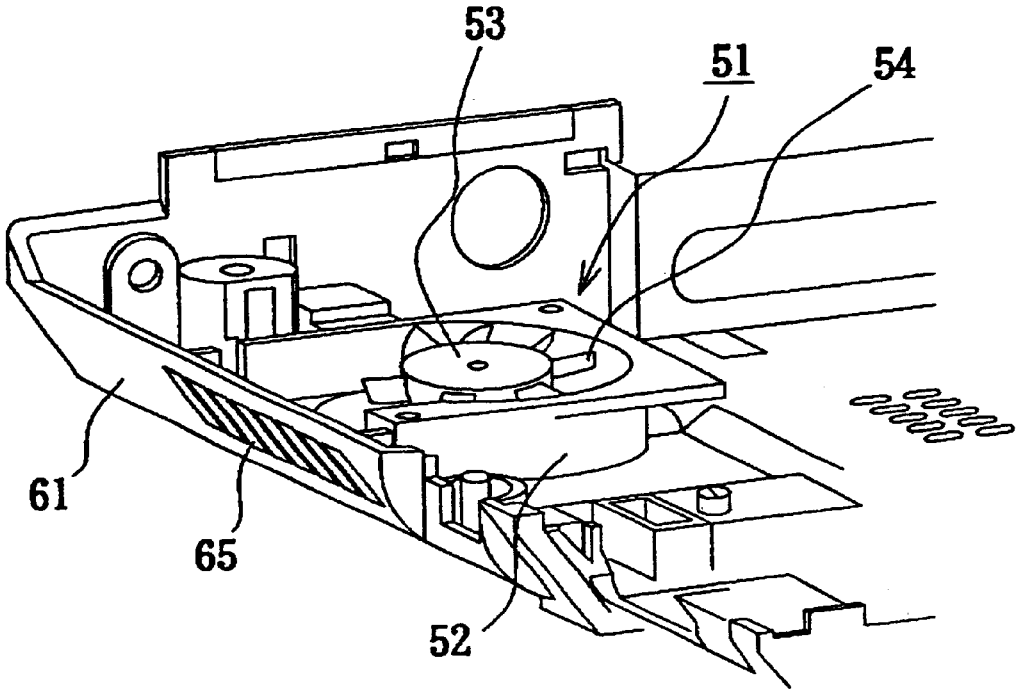
Figure 7 (Prior Art)
FIG. 7 is a perspective view illustrating the installation of any one of the previous fans in a conventional notebook PC.
Figure 8:
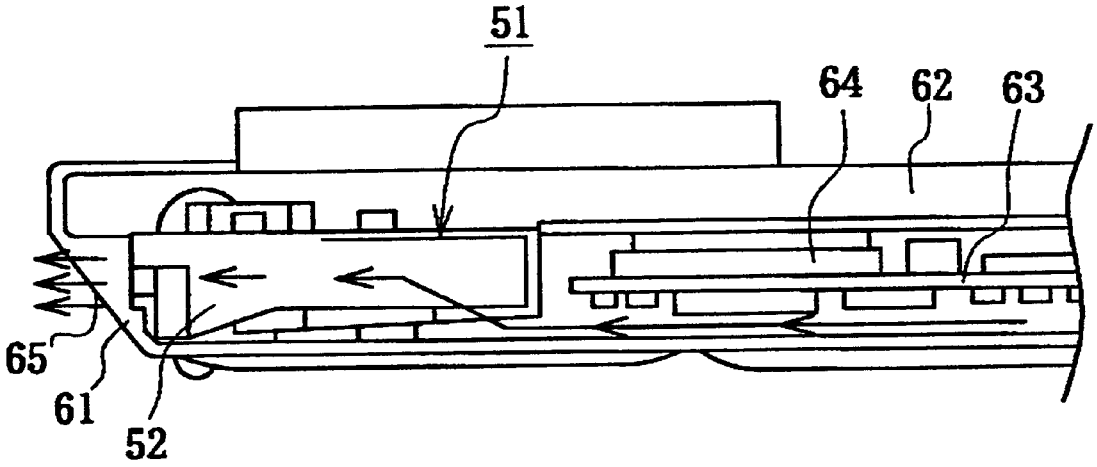
Figure 8 (Prior Art)
FIG. 8 is a schematic side view illustrating the positional relationship between the fan and the notebook PC cover.

FIG. 4 shows the measurement results of the fan having the blades formed completely in the same shape as shown in FIG. 3(*a*). FIG. 5 shows the measurement results of the fan for which putty is put at four blades near to a portion attached to the hub respectively. Those blades are disposed alternately as shown in FIG. 3(*b*). FIG. 6 shows the measurement results of the fan for which putty is put on all the blades as shown in FIG. 3(*c*).

In FIGS. 4 through 6, the average sound pressure value (found after dBV (a sound pressure unit used for the measurement results) is converted to dBA) is 40.2 dBA for the fan having the blades formed completely in the same shape, 39.2 dBA for the fan for which putty is put on the four blades disposed alternately, and 40.0 dBA for the fan for which putty is put on all the blades. As a result of above measurements, it was found that the sound pressure was reduced most (about 1 dBA) and the sound was soft in the fan for which putty was put on four blades disposed alternately. It was also found that the peak frequency range was the lowest in the fan for which putty was put on four blades disposed alternately. Although the embodiment of the present invention is as described above, it is to be understood apparently that variations may be made without departing from the spirit and scope of the present invention.

As described above clearly, according to the present invention, because the periodic occurrence of the air pressure change caused by the shape of each blade of the fan is reduced, the sound of the rotating fan can be softened. More concretely, because the shape of each blade is slightly varied from another, thereby eliminating the periodical occurrence of the air pressure change, the noise level of the fan can be suppressed within the allowable value even when the number of blades and the rotational speed of the fan are increased so as to increase the air flow rate. Consequently, the present invention can provide a fan that can increase the air flow rate while the noise level is suppressed within the allowable value and a PC equipped with such a fan.

What is claimed is:

1. A fan, comprising:

a hub;

a plurality of blades attached to said hub, wherein the blades differ in shape from one another to an extent that an air volume handling capacity of the blades is not substantially diminished; and wherein the blades differ in shape due to the presence of an adhesive on at least one of the blades.

2. The fan according to claim 1 wherein the adhesive is put on one of a front surface and a back surface of said at least one of the blades near the hub.

3. The fan according to claim 2 wherein said adhesive covers an entirety of said at least one of the blades.

4. The fan according to claim 2 wherein said adhesive is located on alternating ones of the blades to define adhesive blades and non-adhesive blades.

5. The fan according to claim 3 wherein said adhesive is located on alternating ones of the blades to define adhesive blades and non-adhesive blades.

6. The fan according to claim 2 wherein said adhesive is putty.

7. The fan according to claim 3 wherein said adhesive is putty.

8. The fan according to claim 1 wherein the number of said blades exceeds seven.

9. The fan according to claim 1 wherein the number of said blades is nine.

10. The fan according to claim 1 wherein said fan has a rotational speed of at least 5200 rpm.

11. The fan according to claim 1 wherein said fan is a personal computer fan.

12. A personal computer, comprising:

a cooling fan provided with a plurality of blades, wherein the blades differ in shape from one another, due to the presence of an adhesive on at least one of the blades, to an extent that an air volume handling capacity of the blades is not substantially diminished.

* * * * *